US005247139A

United States Patent [19]

Schon et al.

[11] Patent Number: 5,247,139

[45] Date of Patent: Sep. 21, 1993

[54] TWO-CHANNEL FORKED LIGHT BARRIER DETECTING VERTICAL POSITION

[75] Inventors: Rainer Schon, Balzers, Liechtenstein; Martin Kirchner, Berschis, Switzerland; Bernhard Sprecher, Vattis, Switzerland; Daniel Wildisen, Aesch, Switzerland

[73] Assignee: Inventio AG, Hergiswil NW, Switzerland

[21] Appl. No.: 786,085

[22] Filed: Oct. 31, 1991

[30] Foreign Application Priority Data

Oct. 31, 1990 [CH] Switzerland ..... 03457/90

[51] Int. Cl.[5] ..... B66B 1/00

[52] U.S. Cl. ..... 187/104; 187/105; 187/113; 187/133; 187/134; 307/149

[58] Field of Search ..... 187/104, 134, 113, 105, 187/133; 307/149

[56] References Cited

U.S. PATENT DOCUMENTS

| | | | |
|---|---|---|---|
| 3,743,056 | 7/1973 | Zitelli et al. | 187/134 |
| 3,743,058 | 7/1973 | Diamond | 187/104 |
| 4,019,606 | 4/1977 | Caputo et al. | 187/134 |
| 4,088,900 | 5/1978 | Klopsch et al. | 307/149 |
| 4,362,224 | 12/1982 | Fairbrother | 187/113 |
| 4,785,914 | 11/1988 | Blain et al. | 187/105 |
| 4,898,263 | 2/1990 | Manske et al. | 187/133 |
| 4,977,984 | 12/1990 | Arnosti et al. | 187/134 |

*Primary Examiner*—Steven L. Stephan
*Assistant Examiner*—Thomas M. Dougherty
*Attorney, Agent, or Firm*—William J. Clemens

[57] ABSTRACT

A two-channel forked fail-safe light barrier generates shaft position information in the region of the floors for the premature opening of the doors on arrival of an elevator car and includes a cyclical dynamic self-monitoring circuit by means of which a prophylactic fault recognition is possible. The self-monitoring circuit is responsive to the arrival and standstill of the car at a floor and periodically simulates genuine operational sequences as a brief emergence of the switching vane by an optical short-circuit of the fail-safe light barrier. The simulation effects interruption of the light barrier relay power which is, however, shorter than the release time of the relays so that the relays do not release when the circuit is intact. A sequence of timing signals controls the sequence of the self-monitoring functions and, in the case of any kind of component faults, this sequence is disturbed and a corresponding reaction in the safety circuits of the elevator control takes place by way of the relay contacts. A cyclically appearing test signal is generated as the primary control signal for the simulated interruptions.

11 Claims, 4 Drawing Sheets

TWO-CHANNEL FORKED LIGHT BARRIER DETECTING VERTICAL POSITION

BACKGROUND OF THE INVENTION

The present invention relates generally to an elevator system and, in particular, to a two-channel forked light barrier apparatus for the generation of car position information on the entry of a switching vane in the region of the door zones in elevator shafts for the purpose of the premature initiation of the opening of the doors on the arrival of the elevator car at a target floor.

The present invention concerns the premature initiation of the opening of the doors on the arrival of an elevator car at a target floor which sets high demands on equipment and circuits and which, within a door zone at the stopping position, bridges over the door and lock contacts in the final phase of the arriving elevator car. There exist regulations and standards which prescribe or recommend the function and a portion of the construction of such devices. Sub-assmblies, which meet these relevant safety regulations, are known as "fail-safe" devices. Generally, such apparatus have circuits which are constructed to be secure against failure in that a fault or a combination of faults cannot cause any dangerous state for the equipment to be controlled, in this case an elevator.

The European Patent Application No. 0357 888 describes a method and a device for the generation of elevator shaft position information by means of a safety light barrier. Test loops internal to the light barrier circuit monitor, statically in the rest position and dynamically during the travel of the elevator car on the entry and exit of the light barrier into or out of the actuating vanes in the shaft, the correct functioning of the circuit and, in the case of a fault, issue corresponding fault signals.

The U.S. Pat. No. 3,743,056 describes a fail-safe detector which has a failure-proof circuit and is protected particularly against external light and reflections.

Both of the above-described circuits have the disadvantage that a fault is discovered only when the corresponding function is used and the circuit is not constructed in a redundant fashion.

SUMMARY OF THE INVENTION

The present invention concerns the task of creating a fail-safe light barrier, the functional reliability and readiness of which is known before each journey of the elevator car. This problem is solved by a two-channel forked fail-safe light barrier for the generation of elevator shaft position information on the entry of a switching vane in the shaft in the region of the door zones in elevators for the premature initiation of the opening of the doors on the arrival of the elevator car at a target floor. A light barrier has a slot formed therein and a two-channel light barrier circuit detects entry into and exit from the slot of a switching vane. At least one cyclically dynamic self-monitoring circuit is connected to the light barrier circuit for detecting faults in components in the light barrier circuit and for initiating a simulated operating sequence in the light barrier circuit by simulating exit of the switching vane out of the slot in the light barrier.

The self-monitoring circuit includes a plurality of timing signal circuits connected together for generating timing signals in a predetermined sequence for controlling the simulated operating sequence of the light barrier circuit. The timing signal circuits are divided into two channels and include a flip-flop circuit which is common to both of the channels and initiates a cycle time in response to outputs from one of the timing signal circuits in each of the channels. The light barrier circuit includes at least one relay for actuating associated contacts and the self-monitoring circuit generates a periodic test signal for interrupting the application of power to the relay for a predetermined time, which predetermined time is shorter than a release time for the relay. One of the timing signal circuits in one of the channels generates a pulse displacement time delay for the timing signals of the one channel with respect to the timing signals of the other channel. The self-monitoring circuit generates a test signal to the light barrier circuit and one of the timing signal circuits generates a timing signal overlapping the test signal. The light barrier circuit generates a pair of light beams in mutually opposite directions through opposed placement of a pair of light transmitting diodes on opposite sides of the slot.

The advantages achieved by the invention are to be seen substantially in that a possible fault in the light barrier is recognized before the departure of the elevator car on the journey and, thus, an emergency stop between two floors because of an open safety circuit is prevented.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
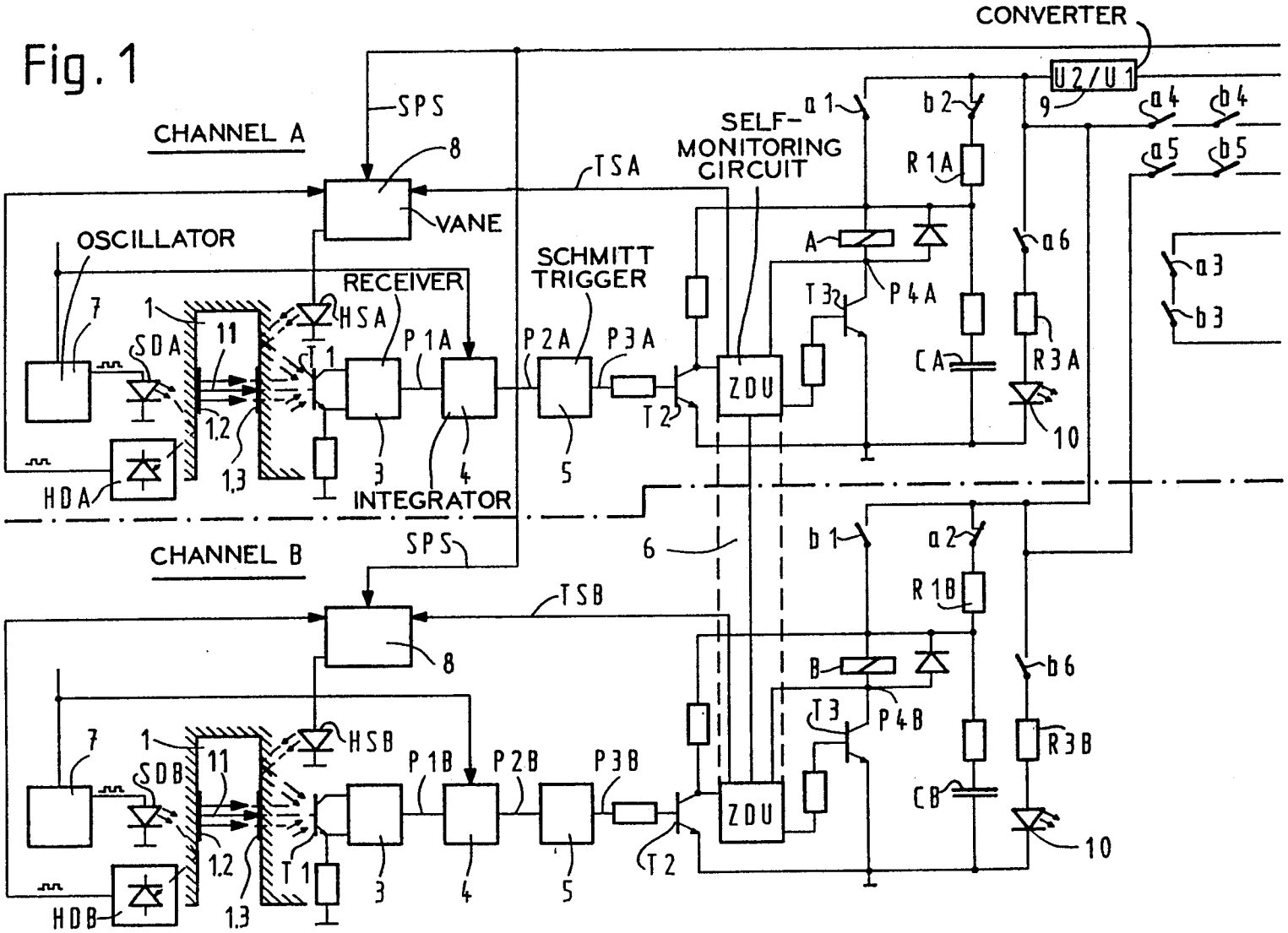
FIG. 1 is a block schematic diagram of a light barrier apparatus according to the present invention.

All parts of the equipment and their relationships one to the other are illustrated in the form of a block schematic diagram in the FIG. 1 showing a light barrier in accordance with the present invention. A pair of slots 1, into which the (not illustrated) switching vanes enter and from which they emerge during the travel of the elevator car and in that case interrupt a light beam 11, of a forked light barrier, are formed in the light barrier. On the stopping of the elevator at a floor, the light beam 11 is interrupted continuously by the switching vane located in the elevator shaft. In a Channel A, an oscillator 7 controls a pulse-operated infra-red transmitting diode SDA. The diode SDA transmits its light through an exit window 1.2 formed in a wall of the slot 1 through an intermediate space in the slot 1 and into an entry window 1.3 formed in an opposite wall. Behind the entry window 1.3 is a phototransistor T1 which converts the light pulses into current pulses which are then prepared in a receiver and signal amplifier 3 and generated as a strong output signal at a measurement point P1A at the output of the receiver and amplifier 3. The signal pulses, keyed by the oscillator signal, are integrated in the sequence in an integrator 4 into a continuous signal which is then available at a measurement point P2A at the integrator output. Interference signals, which do not conform to the oscillator frequency, and other possible stray signals are keyed out and eliminated in this manner. A following Schmitt trigger 5 provides a clean or sharp switching edge on an output signal at a measurement point P3A. The next switching stage is a transistor T2 which is connected to an input of a cyclically dynamic self-monitoring circuit 6 (or ZDU) which controls a relay switching stage having a transistor T3.

A measurement point P4A is situated at the connection between the collector of the transistor T3 and a relay coil A. The relay coil A is connected in the usual manner with a reverse diode and actuates operating contacts CA and a set of six contacts A1 to A6. The relay coil A is connected by way of a resistor R1A and a contact b2 with a supply voltage which originates from a voltage converter and interference filter 9. The relay contacts b1 to b6 are components of a relay B in the similar Channel B of the fail-safe light barrier. The contact combination a4/b4, a5/b5 and a3/b3 present on the one hand status information data and on the other hand form portions of the contact safety circuit in the elevator control. A light-emitting diode 10 functions as an optical state check and is driven by the contact a6 by way of a resistor R3A. A connection from the measurement point P4A leads back to the ZDU 6. An output leads from the ZDU 6 with a periodic test signal TSA to a bridging-over floor vane 8 which receives an input blocking signal SPS and a further input of the oscillator frequency originating from a photodiode HDA. An auxiliary transmitter HSA is operated in dependence on an input signal from the bridging-over floor vane 8. A portion of the light pulses emitted by the transmitting diode SDA are reflected to act also on the photodiode HDA, the pulse signals of which are continuously present at the corresponding input of the bridging-over floor vane 8 and are passed on to the auxiliary transmitter HSA on the arrival of the test pulse TSA or the blocking signal SPS. The light pulses of the auxiliary transmitter HSA then act on the phototransistor T1 whereby the process known as an optical short-circuit is concluded.

Figure 2:
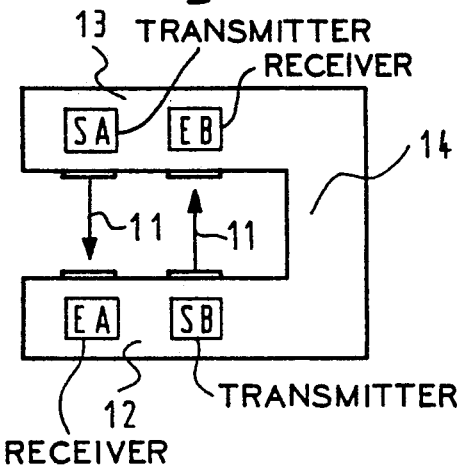
FIG. 2 is a schematic plan view of the location of the transmitters and receivers in the light barrier shown in the FIG. 1.

The FIG. 2 shows the mutual arrangement of the Channels A and B with the transmitters SA and SB and the receivers EA and EB in the fork limbs 12 and 13 of a forked sensor housing 14. The light beams 11 of both of the transmitters SA and SB are directed in mutual opposition so that no stray light of a transmitter can be received by a receiver of the neighboring channel.

The functions of the fail-safe light barrier with its ZDU 6 are described by reference to the FIGS. 3 to 7. The normal function of the fail-safe light barrier is illustrated by the wave form diagram in the FIG. 3. The first vertical line, marked by "in", represents the instant at which a switching vane in the shaft just interrupts a light beam 11 in the fail-safe light barrier. The second vertical line, marked "out", represents the instant at which the switching vane in the shaft just emerges from the fail-safe light barrier and frees the light beam 11. Before the entry at the switching vane, the pulsating signal at the left of the "in" line is originating from the transmitting diode SDA and is present at the measurement point P1A. On the entry of the switching vane, the signal disappears suddenly and the integrator 4 (FIG. 1) discharges which is evident at the measurement point P2A. After the signal falls below the lower trigger threshold value, P3A becomes zero and consequently also P4A whereby the relay A is connected to the power supply and the relay A can operate after a delay time "tan". The same operation also occurs in the channel B with the relay B. When both the relays A and B have operated within a preset time, the control commands for the premature opening of the doors can be given when the elevator is about to arrive at a target stopping floor. The relays A and B remain operated for as long as the elevator remains at a floor and the light beam 11 remains interrupted by a switching vane. On the departure of the elevator from a floor and the thereby entailed emergence of the switching vane from the fail-safe light barrier, the pulsating signal immediately appears at the point P1A, the integrator 4 charges up, the signal at the point P3A switches at the threshold value to "one", the signal at the point P4A switches likewise and the relay A (and B) releases after a time "tab". On the travel of the elevator past the floors without stopping, it is desired that the relays A and B then not operate and release each time on the entry of the switching vanes into the fail-safe light barrier and their emergence therefrom. For this reason, a blocking signal SPS is formed, for example by the control computer, and brings about the already described optical short-circuit and thus makes the switching vanes so to speak invisible to the fail-safe light barrier.

Figure 5:
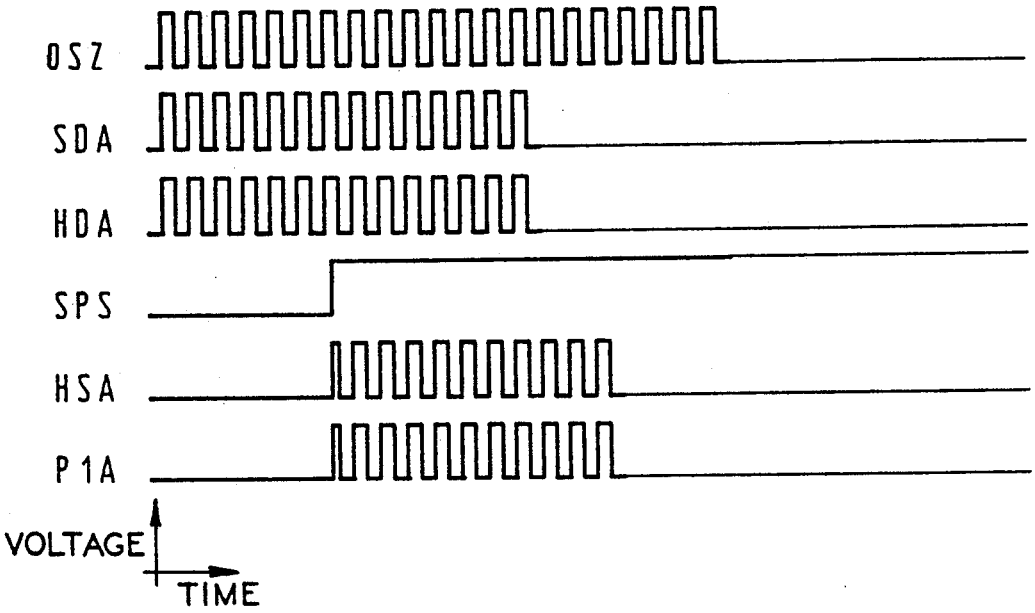
FIG. 5 is a wave form diagram of the signals generated in the circuit shown in the FIG. 1 by a bridging-over floor vane.

The effect of the SPS signal is evident in the wave form diagram of the FIG. 5. At the instant at which SPS becomes active, the auxiliary transmitter HSA is switched on by the bridging-over floor vane 8 and the filter transistor T1 is acted on by the transmitter output signal. Since the light pulses have their origin at the transmitting diode SDA and are returned by way of the filter diode HDA to the bridging-over floor vane 8, the original signal makes no difference for the following circuit and the relays A and B remain released or do not react to any switching vane as long as the blocking signal SPS is active. These additional optical elements are the basis for the performance of the ZDU (cyclically dynamic self-monitoring circuit) for the fault recognition. By the term "dynamic", the manner of functioning of the monitoring is qualified to an operational function, and the term "cyclical" is an indication of the periodic repetition of the monitoring function in time.

Figure 3:
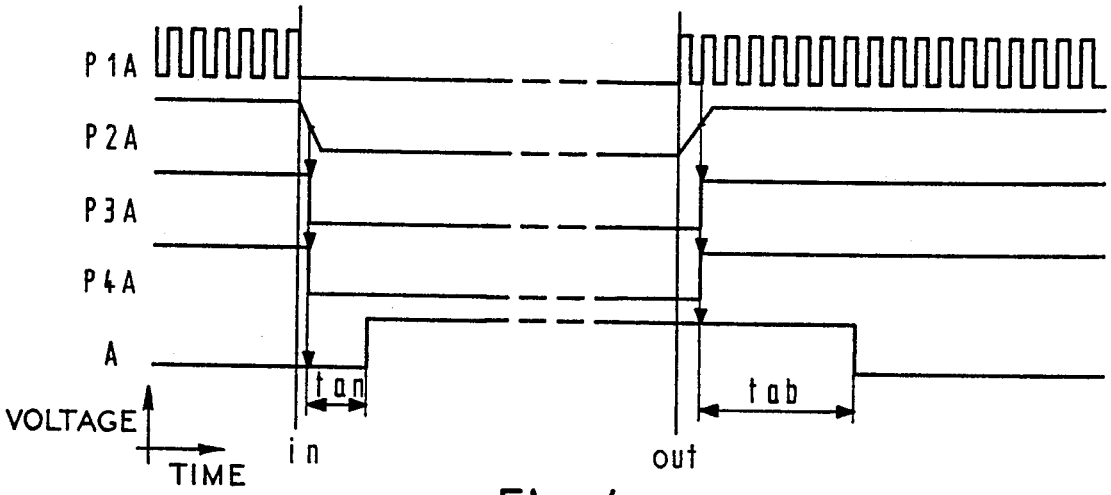
FIG. 3 is a wave form diagram of the signals generated in the circuit shown in the FIG. 1 with an entering and emerging switching vane.
Figure 4:
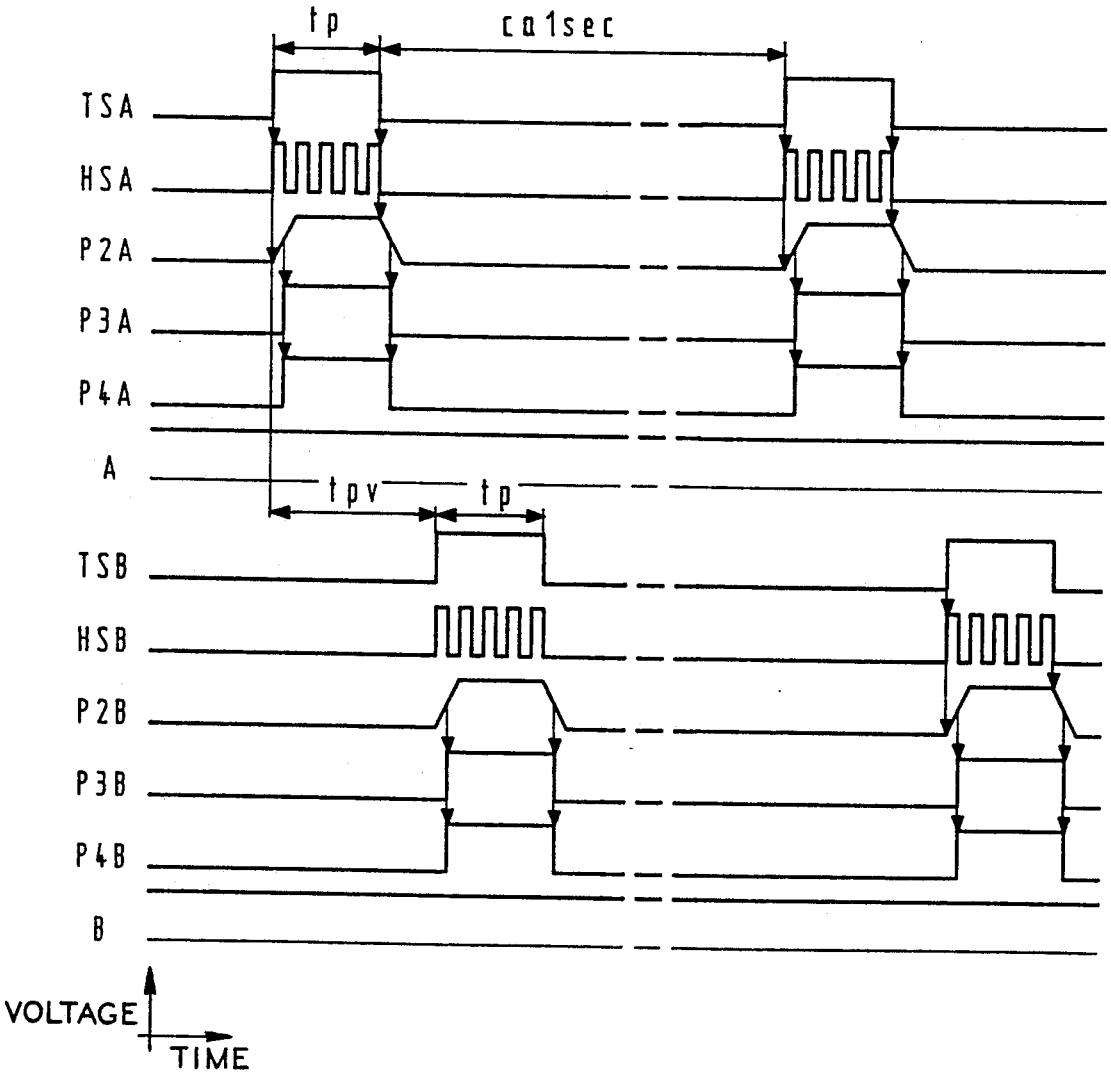
FIG. 4 is a wave form diagram of the signals generated in the circuit shown in the FIG. 1 during cyclically dynamic self-monitoring.
Figure 8:
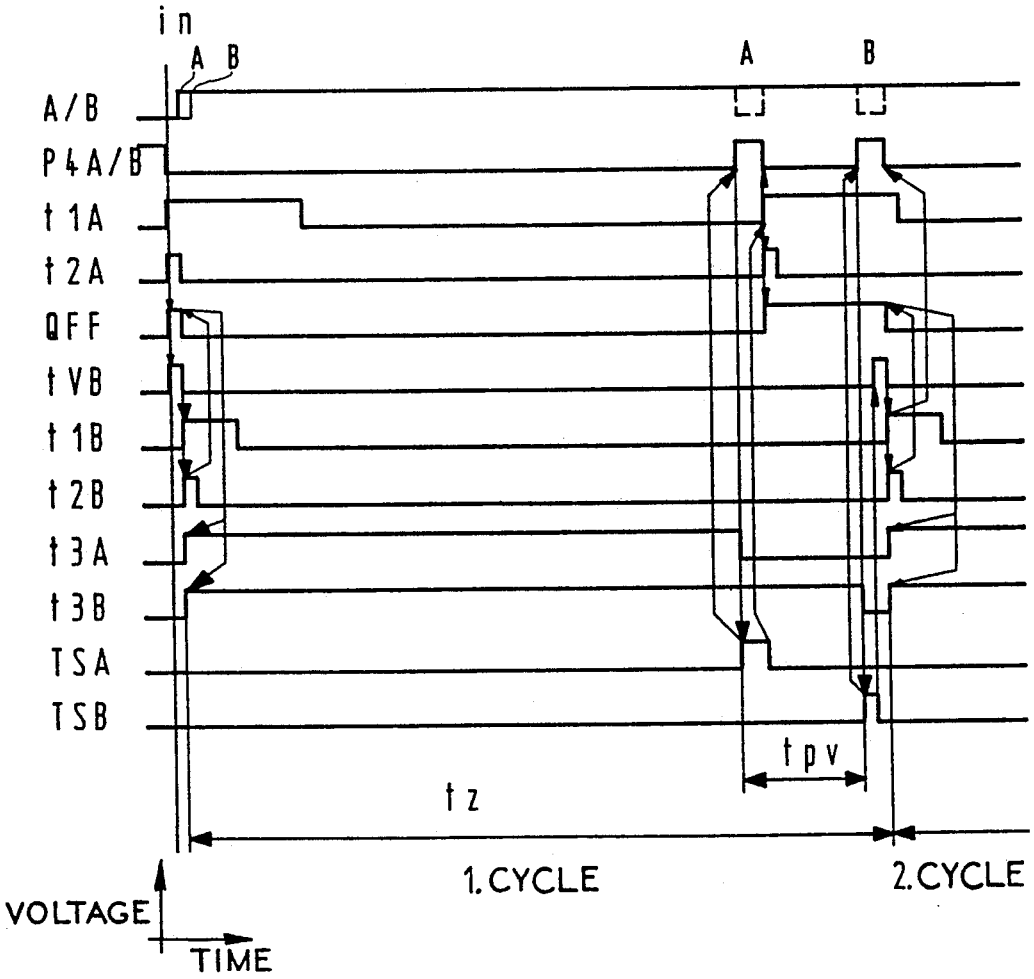
FIG. 8 is a wave form diagram of the signals generated in the cyclically dynamic self-monitoring circuit shown in the FIG. 7.

It is important to immediately recognize faulty elements and faults in the function at any time. The test signals TSA of the channel A and TSB of the channel B coming from the ZDU 6 are illustrated in the wave form diagram of the FIG. 4. The test signals TSA and TSB display a pulse length "tp", which is, for example, shorter by half the relay release time "tab" (FIG. 3). Furthermore, the test signals TSA and TSB are displaced one relative to the other in time by a time "tpv" (FIG. 8). The time displacement serves to prevent any mutually interfering influence from the monitoring functions in each channel. A brief emergence of the switching vane during the time which the elevator stands at rest at the floor is simulated by the test signals TSA and TSB. The functions correspond in principle to those as illustrated in the wave form diagram of the FIG. 3 with the difference that they are inverse and are very much shorter in time. All elements participating in the operating function are tested by the ZDU 6 during the respective sequence of functions. In the case of a fault, the monitoring cycle is interrupted, whereupon at least one relay A or B releases and the safety circuit of the elevator responds thereby.

Figure 6:
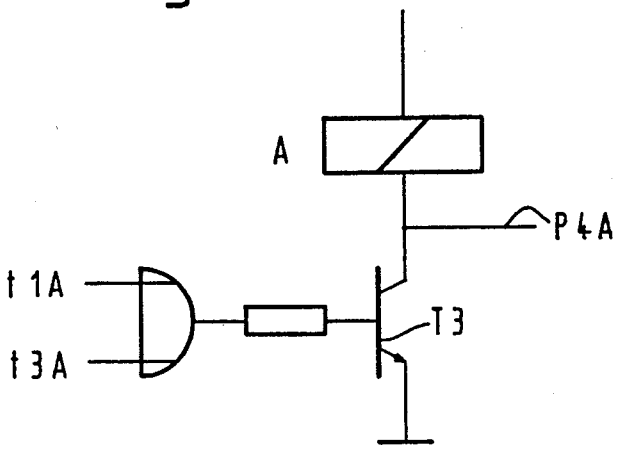
FIG. 6 is a schematic diagram of the relay switching stage with drive shown in the FIG. 1.
Figure 7:
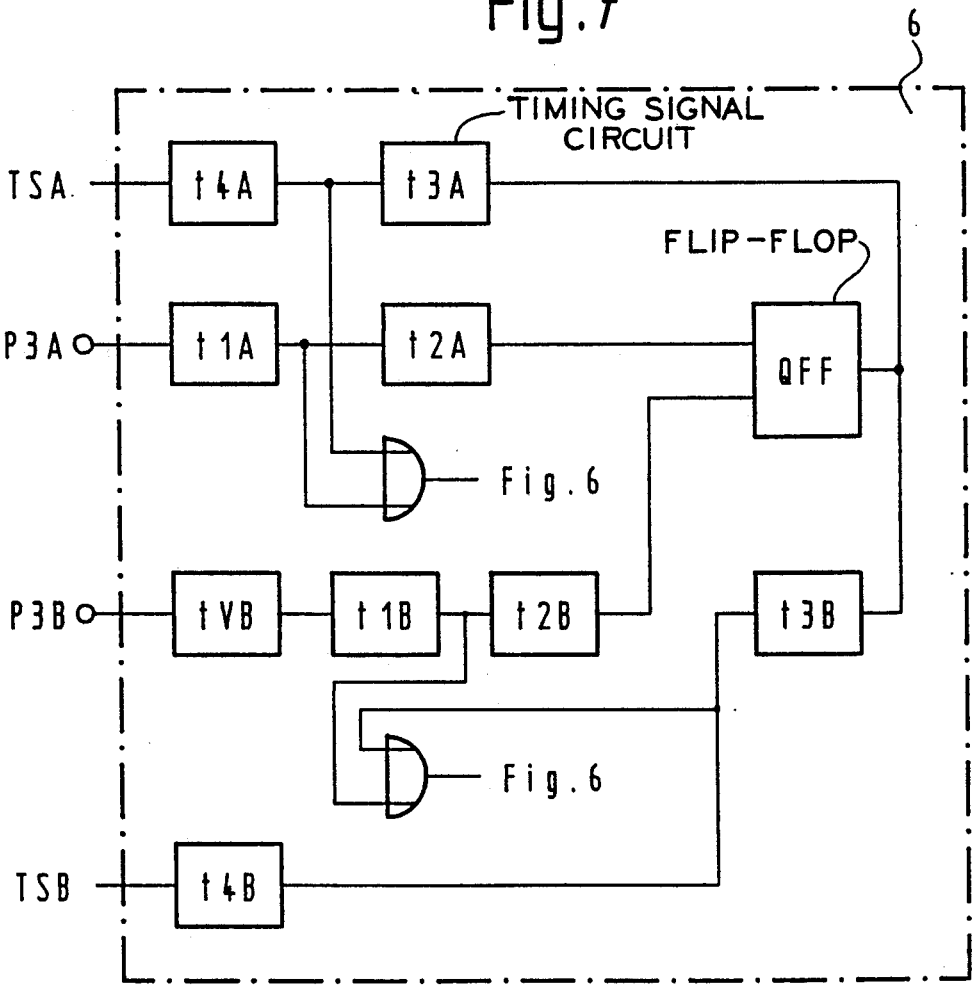
FIG. 7 a block schematic diagram of the cyclically dynamic self-monitoring circuit shown in the FIG. 1.

The ZDU 6 consists substantially of a number of mutually dependent timing signal circuits. The timing signals and circuits are called t1A, t2A, t3A and t4A for the channel A and tlB, t2B, t3B, t4B, and tVB for the channel B (FIG. 7). The details of the relay switching stage with the switching transistor T3 and its drive by an OR gate are illustrated in the FIG. 6. The inputs of the OR gate are the timing signals t1A and t3A. The relay A thus has voltage applied to it when one or both inputs are equal to one and does not have the voltage applied to it when both inputs are equal to zero. The ZDU 6 now has the effect that both inputs t1A and t3A periodically become zero briefly without the relay A in that case releasing. The timing signals t1A to t4A or tVB and t1B to t4B, as well as both the OR-gates and a flip-flop QFF, are illustrated as blocks with the appropriate connections in the FIG. 7. The illustrated blocks are the substantial content of the block ZDU 6 in the block schematic diagram of the FIG. 1. The upper part of the block schematic diagram shows the elements of the A channel and the lower part those of the B channel. QFF is a common element and has a task of synchronization. An additional time signal circuit tvB is present in the B channel and has the task of causing a pulse displacement for the purpose of the formation of a QFF starting signal.

The shape of the timing signals over time is illustrated in the wave form diagram of the FIG. 8. Shown in addition to the timing signals are the test signals TSA and TSB, the measurement points P4A/B, the relays A/B as well as the output of the JK-flip-flop QFF. The timing signal t1A is a bridging-over signal and about twice as long as the signal t1B. The timing signals t2A and t2B are short control signals for QFF and the timing signals t3A and t3B are started together by the falling edge of the QFF signal. However, the signals t3A and t3B display a length differing by "tpv", for which t3A is smaller than t3B. The instant zero of the diagram is defined by the entry of the switching vane and indicated by the vertical line marked "in" at the top. Initially, t1A, which is identical with the signal at the point P3A, becomes one and produces the switching pulse t2A, which in turn makes the QFF signal equal to one. At the same time, the relay A is turned on by way of the P4A signal and operates after a time "tan". In the channel B, the timing signal tVB is started first and only after the termination thereof is the relay B turned on whereby voltage is applied to it for example two milliseconds later. The end of the timing signal tVB produces the switching pulse t2B, which then makes the QFF signal again equal zero. The felling edge of the QFF signal is now the starting signal, synchronizing both channels, for the timing signals t3A and t3B. The time difference corresponds to the test signal delay time tPV in the wave form diagram of the FIG. 4.

After the termination of the t3A signal, the first test begins in the Channel A in that a test signal TSA is formed by way of the t4A signal, which signal for its duration makes the measurement point P4A equal to one and thus a time gap of equal duration arises for the relay holding. Its duration is however, as already mentioned, only about half as long as the release time of the relay A so that this relay cannot release. After termination of the TSA signal, a switching pulse t2A is produced again, which now makes t1A equal to one. The t1A signal has a length which overlaps in time the function of the following test in the Channel B. The interruption in the relay holding is thus in effect for a time gap in both the time signals t1A and t3A (FIG. 6). After a time, "tPV", the t3B signal now almost becomes zero and the same sequence now produces the equally long interruption in the relay holding of the Channel B. Since the timing signal tVB is now however present in the Channel B, TSB must be shorter by this amount in order to effect the equally long interruption. The time gap in the relay holding of the Channel B is thus composed of the duration of TSB and tVB. At the end of tVB, the QFF signal becomes zero by way of the switching pulse t2B and starts the timing of the signals t3A and t3B anew, whereby a new cycle begins. The signal t1A can now, after the test in the Channel B is over, terminate without effect and is ready for the next equal function. If any kind of fault now occurs in the circuit, the reaction must go to the safe side, i.e. a relay must release and its contact report the fault to the safety circuits.

The periodic examination of all components comprises interruptions, short-circuits, intermittent failures and drift. Let it be assumed as a first example that the measurement point P3A remains at zero. This could be a short circuit in the transistor T2 or a fault producing this effect in the preceding switching circuits. If the t3A signal has now terminated, no new t1A signal is started, the measurement point P4A becomes one and the relay A releases because neither t1A nor t3A is present at the OR-input in the switching stage. Exactly the same happens when for the same reasons, for example, the signal P3A remains permanently at one. Then, no t1A signal is started, whereby the same effect is achieved. Summarizing, it can be said that any kind of fault in the timing signals leads to the release of the relay A and/or B. The ZDU 6, on standstill of the elevator at a floor, produces switching sequences as they also terminate in operation. For that reason, a prophylactic fault recognition is concerned in this case, because faults in the circuit are recognized before their effect and the consequences are thus mitigated, because an opening of the safety circuit during the travel has the consequence of emergency stops and confined passengers. If a fault is recognized, a start of the elevator is blocked and passengers that have boarded can again leave the car. If components fail during the travel of the elevator with free light paths in the fail-safe light barrier in such a manner that, for example, the light path of the Channel A is simulated as interrupted in spite of the blocking signal SPS being present, then the relay A operates and immediately activates the ZDU 6. The relay B then also operates. For the time difference, during which both the relays operate one after the other, the antivalence of the outgoing relay contacts is disturbed, whereby the fault is reported to the control. After a cycle time "tz", both relays release again because the disturbed channel does not execute the signal change controlled by the ZDU 6.

In the illustrated and described example of the present embodiment, the time signal circuits are executed by means of generally known monostable CMOS multivibrators with RC-connection and an equally known dual J-K flip-flop is used for the flip-flop circuit. The measurement points mentioned in the description serve only for the explanation of function and are in practical embodiment not constructed as separate electrical connections. The illustrated circuit and manner of operation of the fail-safe light barrier can also find application in other fields of technology, where failure-proof apparatus is prescribed, as for example in machine tools, railways, alarm and safety installation. The mode of construction need not be restricted to the forked form: an appropriate sensor can also be constructed as a proximity sensor on the reflection principle.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A two-channel forked fail-safe light barrier for the generation of signals, the signals representing elevator shaft position information on the entry of a switching vane into the barrier, the switching vane being located in the shaft in the region of the door zones in elevators for the premature initiation of the opening of the doors on the arrival of the elevator car at a target floor, the barrier comprising:

a light barrier having a slot formed therein;

a two-channel light barrier circuit for detecting entry into and exit from said slot of a switching vane; and at least one cyclically dynamic self-monitoring circuit connected to said light barrier circuit for detecting faults in components in said light barrier circuit and for initiating a simulated operating sequence in said light barrier circuit by simulating exit of a switching vane out of said slot in said light barrier including a plurality of timing signal circuits connected together for generating timing signals in a predetermined sequence for controlling the simulated operating sequence of said light barrier circuit.

2. The fail-safe light barrier according to claim 1 wherein said self-monitoring circuit has said timing signal circuits divided into two channels and includes a flip-flop circuit which is common to both of the channels and initiates a cycle time in response to outputs from one of said timing signal circuits in each of the channels.

3. The fail-safe light barrier according to the claim 1 wherein said light barrier circuit includes at least one relay for actuating associated contacts and said self-monitoring circuit generates a periodic test signal for interrupting the application of power to said relay for a predetermined time, which predetermined time is shorter than a release time for said relay.

4. The fail-safe light barrier according to the claim 1 wherein said timing signal circuits are divided into two channels and one of said timing signal circuits in one of the channels generates a pulse displacement time delay for the timing signals of said one channel with respect to the timing signals of the other channel.

5. The fail-safe light barrier according to the claim 1 wherein at least two of said timing signal circuits generate timing signals differing one from the other by a pulse displacement time.

6. The fail-safe light barrier according to the claim 1 wherein said self-monitoring circuit generates a test signal to said light barrier circuit and one of said timing signal circuits generates a timing signal overlapping said test signal.

7. The fail-safe light barrier according to claim 1 wherein said light barrier circuit generates a pair of light beams in mutually opposite directions through opposed placement of a pair of light transmitting diodes on opposite sides of said slot.

8. The fail-safe light barrier according to claim 1 including at least one floor vane which is controlled by an input blocking signal and a periodic test signal, a photo-diode connected to an input of said floor vane and an auxiliary transmitter connected to an output of said floor vane, said floor vane controlling said auxiliary transmitter for bridging over said light barrier circuit to effect an optical short-circuit.

9. A two-channel forked fail-safe light barrier for the generation of signals, the signals representing elevator shaft position information on the entry of a switching vane into the barrier, the switching vane being located in the shaft in the region of the door zones in elevators for the premature initiation of the opening of the doors on the arrival of the elevator car at a target floor, the barrier comprising:

a light barrier having a slot formed therein;

a two-channel light barrier circuit for detecting entry into and exit from said slot of a switching vane; and at least one cyclically dynamic self-monitoring circuit connected to said light barrier circuit for detecting faults in components in said light barrier circuit and for initiating a simulated operating sequence in said light barrier circuit by simulating emergence of a switching vane out of said slot in said light barrier, said self-monitoring circuit including a plurality of timing signal circuits connected together for generating timing signals in a predetermined sequence for controlling the simulated operating sequence of said light barrier circuit.

10. The fail-safe light barrier according to claim 9 wherein said self-monitoring circuit has said timing signal circuits divided into two channels and includes a flip-flop circuit which is common to both of the channels and initiates a cycle time in response to outputs from one of said timing signal circuits in each of the channels.

11. A two-channel forked fail-safe light barrier for the generation of signals, the signals representing elevator shaft position information on the entry of a switching vane into the barrier, the switching vane being located in the shaft in the region of the door zones in elevators for the premature initiation of the opening of the doors on the arrival of the elevator car at a target floor, the barrier comprising:

a light barrier having a pair of slots formed therein;

a two-channel light barrier circuit for detecting entry into and exit from each of said slots of a switching vane; and a cyclically dynamic self-monitoring circuit connected to said light barrier circuit for detecting faults in components in said light barrier circuit and for initiating a simulated operating sequence in said light barrier circuit by simulating exit of a switching vane out of said slots in said light barrier including a plurality of timing signal circuits connected together for generating timing signals in a predetermined sequence for controlling the simulated operating sequence of said light barrier circuit and a flip-flop circuit which is common to both of the channels and initiates a cycle time in response to outputs from one of said timing signal circuits in each of the channels, at least two of said timing signal circuits generating timing signals in the channels differing one from the other by a pulse displacement time.

* * * * *